US011063361B2

(12) United States Patent
Suzuki et al.

(10) Patent No.: US 11,063,361 B2
(45) Date of Patent: Jul. 13, 2021

(54) ANTENNA COIL

(71) Applicant: Murata Manufacturing Co., Ltd., Nagaokakyo (JP)

(72) Inventors: Yusuke Suzuki, Nagaokakyo (JP); Shunsuke Kasai, Nagaokakyo (JP)

(73) Assignee: MURATA MANUFACTURING CO., LTD., Nagaokakyo (JP)

( * ) Notice: Subject to any disclaimer, the term of this patent is extended or adjusted under 35 U.S.C. 154(b) by 0 days.

(21) Appl. No.: 16/672,926

(22) Filed: Nov. 4, 2019

(65) Prior Publication Data

US 2020/0067190 A1 Feb. 27, 2020

Related U.S. Application Data

(63) Continuation of application No. PCT/JP2018/017724, filed on May 8, 2018.

(30) Foreign Application Priority Data

May 26, 2017 (JP) ..... JP2017-104822

(51) Int. Cl.
*H01Q 7/08* (2006.01)

(52) U.S. Cl.
CPC ..... *H01Q 7/08* (2013.01)

(58) Field of Classification Search
CPC ..... H01Q 7/08
See application file for complete search history.

(56) References Cited

U.S. PATENT DOCUMENTS 6,795,032 B2 * 9/2004 Ieda ..... H01Q 1/3241 343/711
7,427,963 B2 * 9/2008 Moriya ..... H01Q 7/08 343/713
8,754,823 B2 6/2014 Ohara
9,407,009 B2 * 8/2016 Mahara ..... H01Q 1/1207
10,038,242 B2 7/2018 Imai et al.
2002/0033777 A1 * 3/2002 Maruyama ..... H01Q 7/08 343/713

(Continued)

FOREIGN PATENT DOCUMENTS

JP S44-18178 Y2 8/1969
JP S59152703 A 8/1984

(Continued)

OTHER PUBLICATIONS

International Search Report issued in PCT/JP2018/017724, dated Jul. 10, 2018.

(Continued)

*Primary Examiner* — Seung H Lee
(74) *Attorney, Agent, or Firm* — Arent Fox LLP

(57) ABSTRACT

An antenna coil that adjusts the inductance while suppressing variations in output strength is provided. The antenna coil includes a bar-shaped core made of a magnetic material, a bobbin that holds the core, and wire wound around the bobbin. The wire includes a first coil section arranged at a position corresponding to a first end of the core, a second coil section arranged at a position corresponding to a second end portion of the core, and a third coil section positioned between the first coil section and the second coil section and that is movable in an extending direction of the core.

20 Claims, 12 Drawing Sheets

(56) References Cited

U.S. PATENT DOCUMENTS

| | | | | |
|---|---|---|---|---|
| 2007/0075913 | A1 | 4/2007 | Moriya | |
| 2010/0164822 | A1* | 7/2010 | Iwasaki | H01Q 7/08 343/788 |
| 2011/0241957 | A1* | 10/2011 | Ohara | H01Q 1/3241 343/788 |
| 2016/0315388 | A1 | 10/2016 | Imai et al. | |

FOREIGN PATENT DOCUMENTS

| | | | |
|---|---|---|---|
| JP | S63-12578 | Y2 | 4/1988 |
| JP | 2001102832 | A | 4/2001 |
| JP | 2006121277 | A | 5/2006 |
| JP | 2007288345 | A | 11/2007 |
| JP | 4134173 | B2 | 8/2008 |
| JP | 2011211578 | A | 10/2011 |
| JP | 2016134848 | A | 7/2016 |
| WO | 2005038982 | A1 | 4/2005 |
| WO | 2015107834 | A1 | 7/2015 |

OTHER PUBLICATIONS

Written Opinion of the International Searching Authority issued in PCT/JP2018/017724, dated Jul. 10, 2018.

* cited by examiner

ANTENNA COIL

CROSS REFERENCE TO RELATED APPLICATIONS

The present application is a continuation of PCT/JP2018/017724 filed May 8, 2018, which claims priority to Japanese Patent Application No. 2017-104822, filed May 26, 2017, the entire contents of each of which are incorporated herein by reference.

TECHNICAL FIELD

The present invention relates to antenna coils for use in transmission and reception of radio waves.

BACKGROUND

Currently, an example of an existing antenna coil is disclosed in Patent Document 1 (Japanese Patent No. 4134173). Patent Document 1 discloses the antenna coil including a bar-shaped core, a tubular bobbin movable along the core, and wire wound around the bobbin. The inductance in antenna coils depends primarily on the type of a core (e.g., material or shape), the number of turns of wire, and the position of the wire with respect to the core. The antenna coil described in Patent Document 1 can change the position of the wire with respect to the core by moving the bobbin along the core and can adjust the inductance.

For the antenna coil described in Patent Document 1, however, because of changes in the position of the wire with respect to the core, there is a problem in that variations are present in the output strength (i.e., communication distance), which is one of the most important performance metrics for the antenna coil. Such output-strength variations are noticeable in particular when the antenna coil is used in long-distance communications.

SUMMARY OF THE INVENTION

Accordingly, it is an object of the present invention to solve the above-described problem and provide an antenna coil configured to adjust the inductance while suppressing the variations in the output strength.

To achieve the above-described object, an antenna coil is provided that includes a bar-shaped core made of a magnetic material, a bobbin configured to hold the core, and wire wound around the bobbin.

In an exemplary aspect, the wire includes a first coil section arranged at a position corresponding to a first end portion of the core, a second coil section arranged at a position corresponding to a second end portion of the core, and a third coil section positioned between the first coil section and the second coil section and movable in an extending direction of the core.

The exemplary embodiment of the present invention provides an antenna coil configured to adjust the inductance while suppressing the variations in the output strength.

DETAILED DESCRIPTION OF EMBODIMENTS

Figure 1:
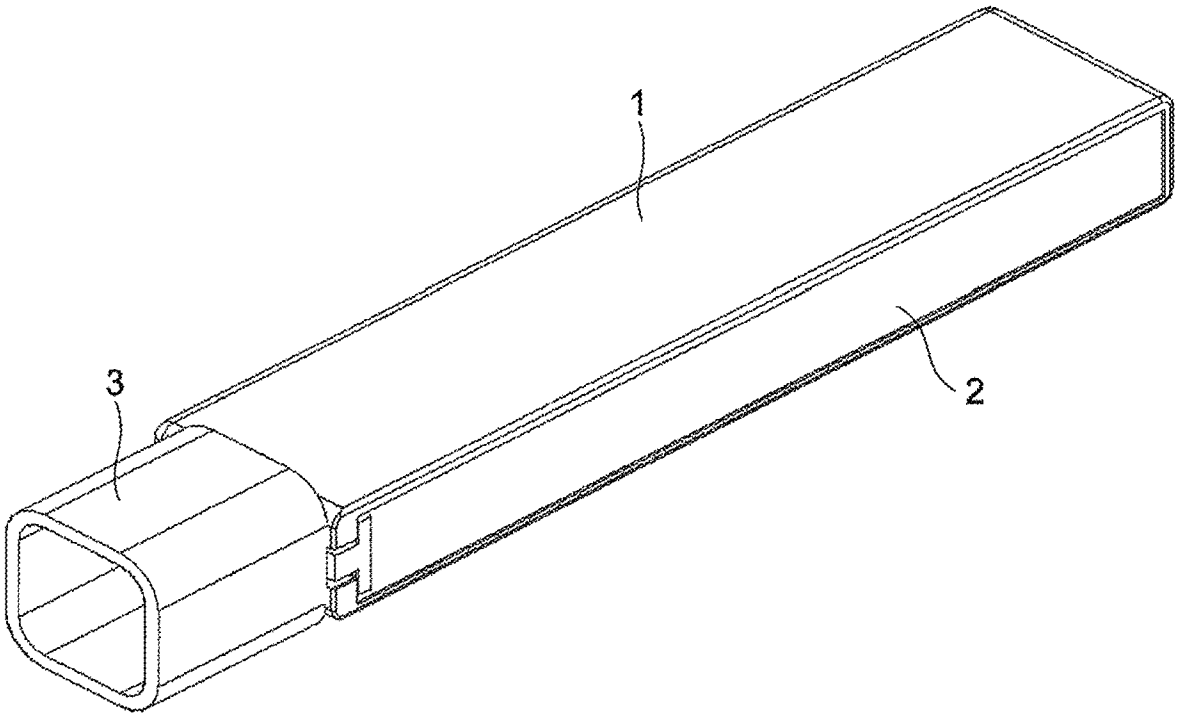
FIG. 1 is a perspective view that schematically illustrates a configuration of an antenna device according to an exemplary embodiment.

An antenna coil according to a first exemplary aspect of the present invention includes a bar-shaped core made of a magnetic material, a bobbin configured to hold the core, and wire wound around the bobbin.

Moreover, the wire includes a first coil section arranged at a position corresponding to a first end portion of the core, a second coil section arranged at a position corresponding to a second end portion of the core, and a third coil section positioned between the first coil section and the second coil section and movable in an extending direction of the core.

The output strength of the antenna coil is significantly affected mainly by magnetic flux output from the end portions of the core. Thus, the output strength is significantly affected by the distance from each of the end portions of the core to the wire. In the above-described configuration, the third coil section, which is positioned between the first coil section and second coil section, can be moved without changing the distance from the first end portion of the core to the first coil section and that from the second end portion of the core to the second coil section. Accordingly, the inductance can be adjusted while variations in the output strength can be suppressed.

In an additional aspect, the antenna coil can further include a sliding member arranged around a region between the first end portion and the second end portion of the core and movable in the extending direction of the core, and the third coil section can be wound around the sliding member and movable in the extending direction of the core. In this configuration, the third coil section, which is positioned between the first coil section and second coil section, can be moved by moving the sliding member without changing the distance from the first end portion of the core to the first coil section and that from the second end portion of the core to the second coil section. Accordingly, the inductance can be adjusted while variations in the output strength can be suppressed.

Moreover, the bobbin can extend in the extending direction of the core, and the sliding member can be arranged around the bobbin and movable in the extending direction of the core. In this configuration, the third coil section, which is positioned between the first coil section and second coil section, can be moved by moving the sliding member without changing the distance from the first end portion of the core to the first coil section and that from the second end portion of the core to the second coil section. Accordingly, the inductance can be adjusted while variations in the output strength can be suppressed.

Yet further, the bobbin can include a first holding section configured to hold the first end portion of the core and a second holding section configured to hold the second end portion of the core, and the sliding member can be arranged between the first holding section and the second holding section and be made of a same material as that of the bobbin. In this configuration, the sliding member can be produced by processing the bobbin, and the producing processes, the producing cost, and the like can be reduced.

In an exemplary aspect, the bobbin can also extend in the extending direction of the core, and the bobbin can have springiness in a portion of a region between a first end portion and a second end portion thereof. In this configuration, because the bobbin itself has springiness, the third coil section can be moved without having the sliding member as a different component. Accordingly, the inductance can be adjusted while variations in the output strength can be suppressed.

Furthermore, the third coil section can be movable within a range nearer the first end portion or the second end portion of the core than a central portion of the core. Because the wire positioned within the range nearer the first end portion or second end portion of the core than the central portion of the core significantly affects the magnetic flux output from the core, the inductance can be adjusted by a smaller amount of movement.

In another aspect, the third coil section can be movable within a range nearer a central portion of the core than the first end portion or the second end portion of the core. Because the wire positioned within the range nearer the central portion of the core than the first end portion or second end portion of the core less affects the magnetic flux output from the core, the inductance can be adjusted while variations in the output strength can be further suppressed.

The antenna coil can further include a regulating member configured to regulate movement of a near portion of the third coil section in a direction remote from the core when the third coil section is moved in the extending direction of the core. In this configuration, malfunctions, such as breaks, caused by swaying of the near portion of the third coil section caused by vibration or the like can be suppressed.

Exemplary embodiments of the present invention are described below with reference to the drawings. The embodiments do not limit the present invention. The same reference numerals are used for substantially the same members in the drawings.

Figure 2:
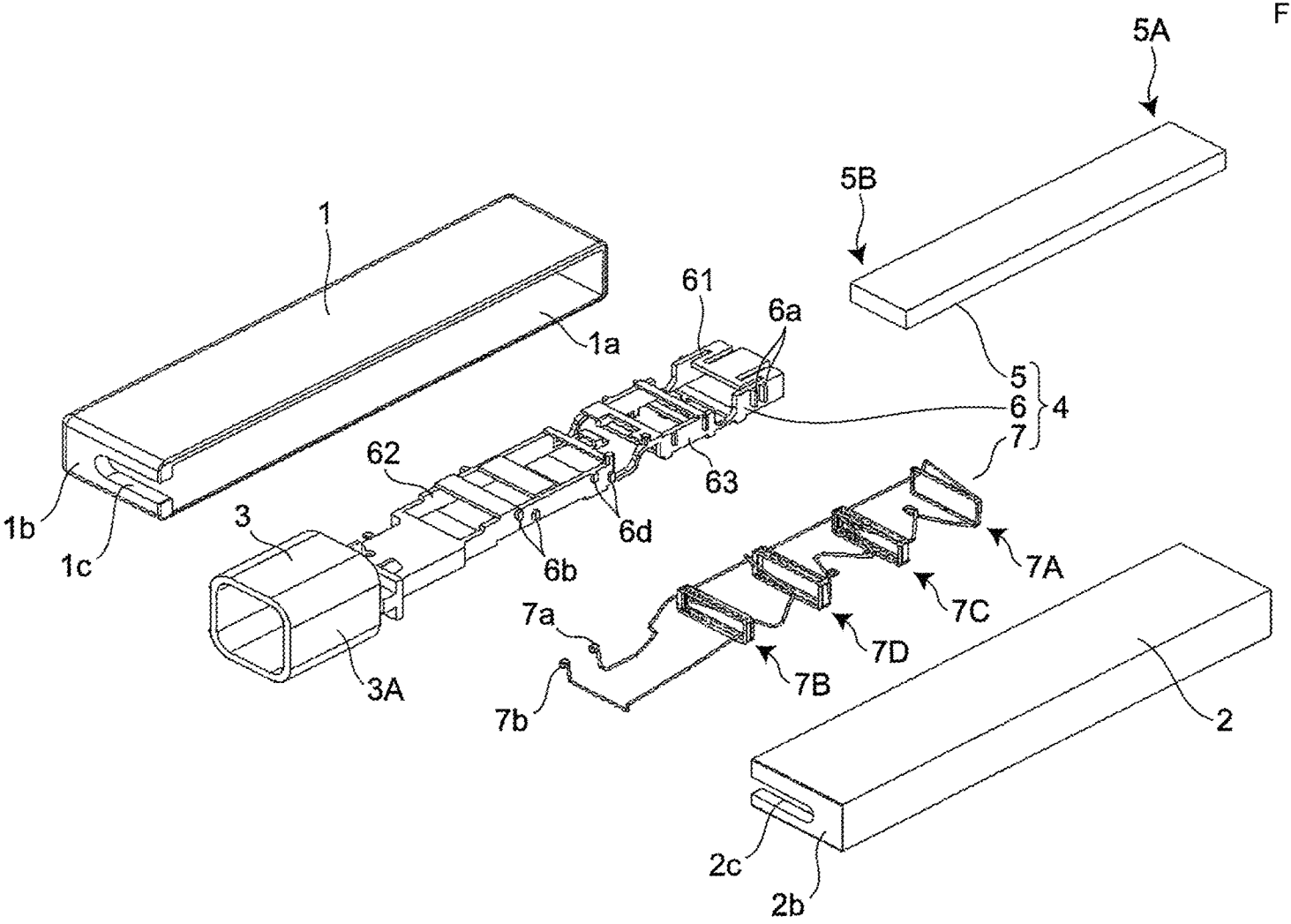
FIG. 2 is an exploded perspective view of the antenna device in FIG. 1.

FIG. 1 is a perspective view that schematically illustrates a configuration of an antenna device according to an embodiment of the present invention. FIG. 2 is an exploded perspective view of the antenna device in FIG. 1. One example of the antenna device according to the exemplary embodiment can be used in long-distance communications (e.g., five or more meters) in a smart keyless system. In another example of the antenna device according to the exemplary embodiment, the device can be attached to a lower area of a door of a vehicle.

As illustrated in FIG. 1 or 2, the antenna device according to the present embodiment includes an antenna case 1, a cover 2, a connector 3, and an antenna coil 4.

As illustrated in FIG. 2, the antenna case 1 is a casing that has a substantially rectangular parallelepiped shape opened at one side surface 1*a* and is configured to hold the antenna coil 4. The antenna coil 4 is connected to the connector 3. The antenna case 1 has a side surface 1*b* adjacent to the connector 3, and the side surface 1*b* has a cut section 1*c* that allows a connection portion where the antenna coil 4 and connector 3 are connected to extend therethrough.

As further shown, the cover 2 has a configuration similar to that of the antenna case 1. That is, the cover 2 is a casing that has a substantially rectangular parallelepiped opened at one side surface and is configured to hold the antenna coil 4 in cooperation with the antenna case 1 by being placed in the antenna case 1, it. The cover 2 has a side surface 2*b* adjacent to the connector 3, and the side surface 2*b* has a cut section 2*c* that allows a connection portion where the antenna coil 4 and connector 3 are connected to extend therethrough.

The connector 3 includes a sleeve 3A made of a resin and a pair of connector pins (illustration is omitted) inside the sleeve 3A. The pair of connector pins are connection terminals to be connected to a circuit substrate or the like.

The antenna coil 4 includes a bar-shaped core 5 made of a magnetic material, a bobbin 6 configured to hold the core 5, and wire 7 wound around the bobbin 6.

The core 5 is a magnetic body placed in the bobbin 6. In the present embodiment, the core 5 is a bar-shaped magnetic body having a rectangular cross section. One example of the core 5 may be made of Mn—Zn based ferrite.

Moreover, the bobbin 6 is a resin member configured to protect the core 5 and suppress breakages of the core 5 caused by deformation or shock provided during producing or when the product is in use. The bobbin 6 has a plurality of openings through which the core 5 is exposed to the outside at a plurality of places. In the present embodiment, the bobbin 6 and the sleeve 3A in the connector 3 are integrally molded from polybutylene terephthalate (PBT).

The bobbin 6 includes a first holding section 61 configured to hold a first end portion 5A of the core 5 and a second holding section 62 configured to hold a second end portion 5B of the core 5. A sliding member 63 movable in an extending direction X (e.g., FIG. 3) of the core 5 is disposed between the first holding section 61 and second holding section 62. In an exemplary aspect, the sliding member 63 is made of the same material as that of the bobbin 6 and is arranged around a region between the first end portion 5A and second end portion 5B of the core 5 (that is, portion other than the first end portion 5A and second end portion 5B). The first holding section 61, second holding section 62, and sliding member 63 are formed as different elements.

One example of the wire 7 may be metal wire, such as copper wire. In the present embodiment, as illustrated in FIG. 2, the wire 7 includes a first coil section 7A, a second coil section 7B, a third coil section 7C, and a fourth coil section 7D, all of which are spirally wound. The first coil section 7A, second coil section 7B, third coil section 7C, and fourth coil section 7D are formed of a single line element made of metal. The number of turns of each of the first coil section 7A, second coil section 7B, third coil section 7C, and fourth coil section 7D is at least one or more.

The wire 7 has a first end portion 7*a* connected to one of the pair of connector pins in the connector 3. The wire 7 has a second end portion 7*b* connected to the other of the pair of connector pins in the connector 3. The first end portion 7*a* or second end portion 7*b* of the wire 7 may be connected to one or the other of the pair of connector pins in the connector 3 with a capacitor (not illustrated) interposed therebetween. In this case, each of the coil sections 7A to 7D and the capacitor can constitute an LC circuit.

Figure 3:
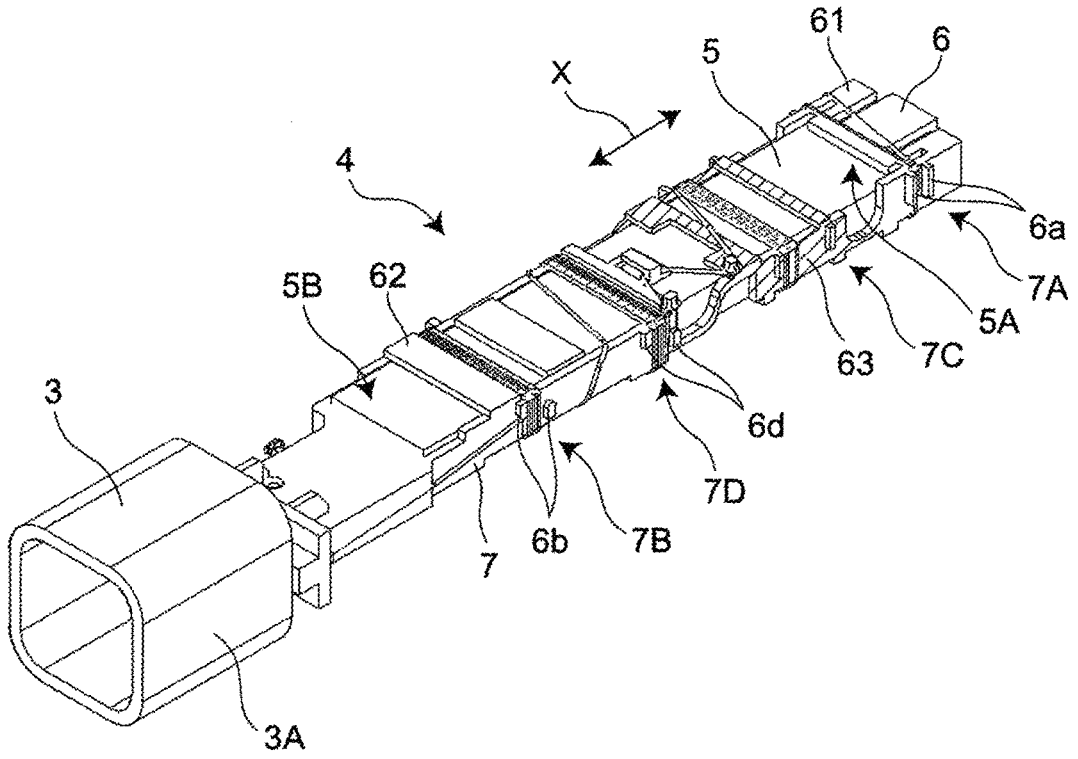
FIG. 3 is a perspective view that illustrates a state where an antenna coil is attached to a connector.
Figure 4:
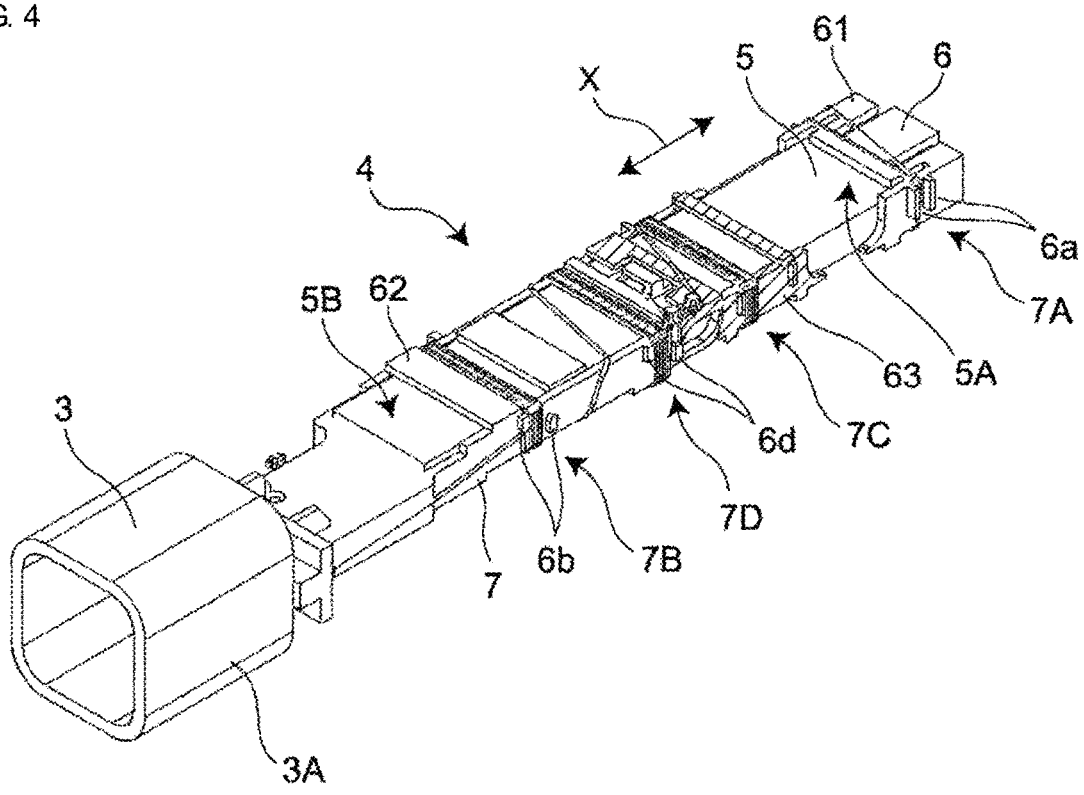
FIG. 4 is a perspective view that illustrates a state where the antenna coil is attached to the connector and illustrates a state where a sliding member is moved in an extending direction of a core.

FIGS. 3 and 4 are perspective views that illustrate states where the antenna coil 4 is attached to the connector 3. In FIGS. 3 and 4, the sliding member 63 is hatched to facilitate the understanding of how the sliding member 63 moves.

As shown, the first coil section 7A is arranged at a position corresponding to the first end portion 5A of the core 5. The second coil section 7B is arranged at a position corresponding to the second end portion 5B of the core 5. The third coil section 7C and fourth coil section 7D are positioned between the first coil section 7A and second coil section 7B.

The movement of the first coil section 7A in the extending direction X of the core 5 is regulated by a pair of ribs 6*a* in the bobbin 6. The movement of the second coil section 7B in the extending direction X of the core 5 is regulated by a pair of ribs 6*b* in the bobbin 6. The movement of the fourth coil section 7D in the extending direction X of the core 5 is regulated by a pair of ribs 6*d* in the bobbin 6.

As illustrated in FIGS. 3 and 4, the third coil section 7C is wound around the sliding member 63 and is movable in the extending direction X of the core 5. In the present embodiment, the coil sections 7A to 7D are arranged at intervals of 30 mm. The sliding member 63 is movable by, for example, about 5 mm to 10 mm in the extending direction X of the core 5 such that the area of the core 5 exposed between the first coil section 7A and third coil section 7C and that between the fourth coil section 7D and third coil section 7C are not excessively large.

According to the exemplary aspect, the output strength of the antenna coil is significantly affected mainly by magnetic flux output from the first end portion 5A of the core 5 and that from the second end portion 5B. Thus, the output strength is significantly affected by the distance from the first end portion 5A of the core 5 to the first coil section 7A and the distance from the second end portion 5B of the core 5 to the second coil section 7B.

In the present embodiment, the third coil section 7C can be moved without changing the distance from the first end portion 5A of the core 5 to the first coil section 7A and the distance from the second end portion 5B of the core 5 to the second coil section 7B. Accordingly, the inductance can be adjusted while variations in the output strength can be suppressed.

Next, a method for producing the antenna device according to the exemplary embodiment of the present invention is described. FIGS. 5 to 10 are perspective views that illustrate an example of the method for producing the antenna device according to the embodiment of the present invention.

Figure 5:
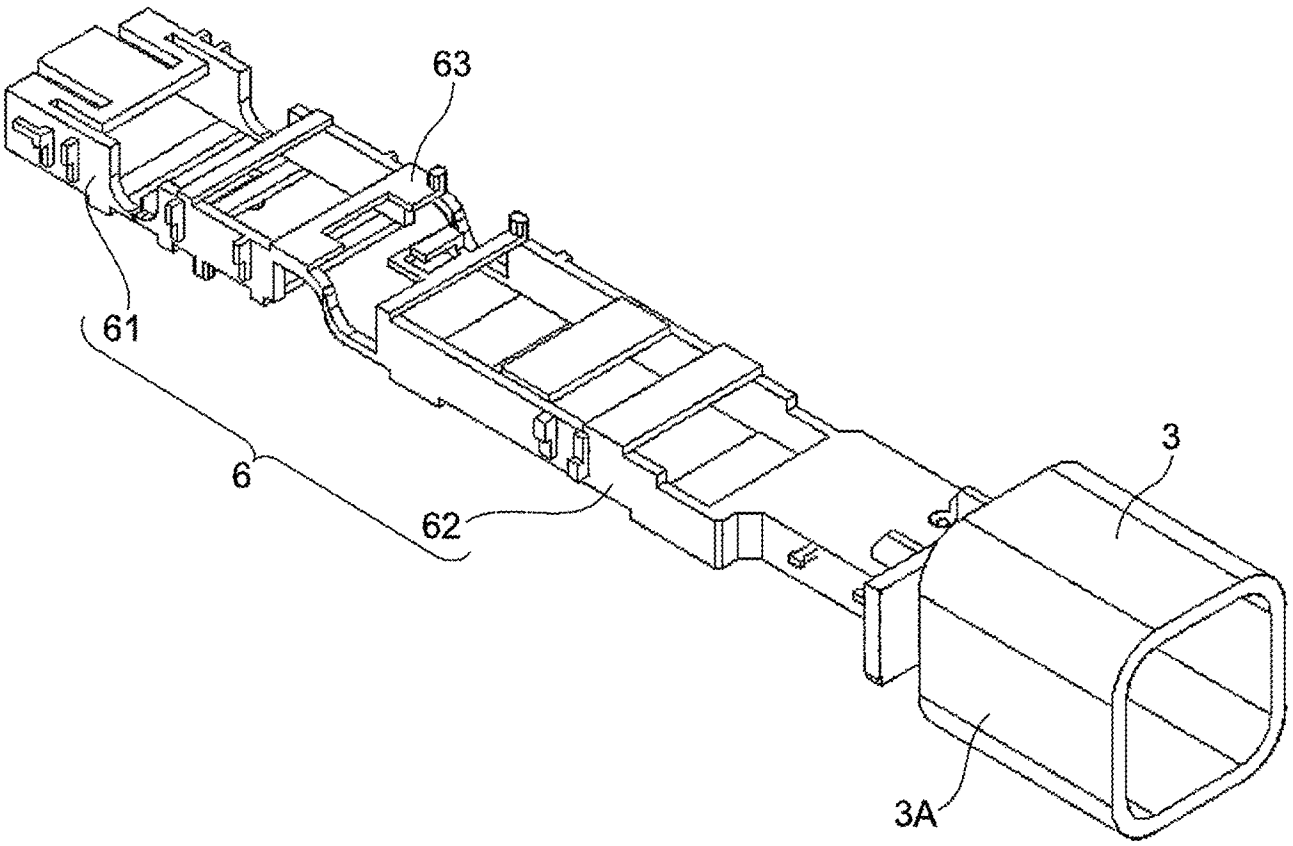
FIG. 5 is a perspective view that illustrates an example method for producing the antenna device in FIG. 1.

First, as illustrated in FIG. 5, the bobbin 6, connector 3, and sliding member 63 are integrally molded from a resin. The connector pins (not illustrated) in the connector 3 may be formed by insert-molding simultaneously with the integral molding of the bobbin 6, connector 3, and sliding member 63. The connector pins in the connector 3 may be formed by outsert-molding after the integral molding of the bobbin 6, connector 3, and sliding member 63.

Figure 6:
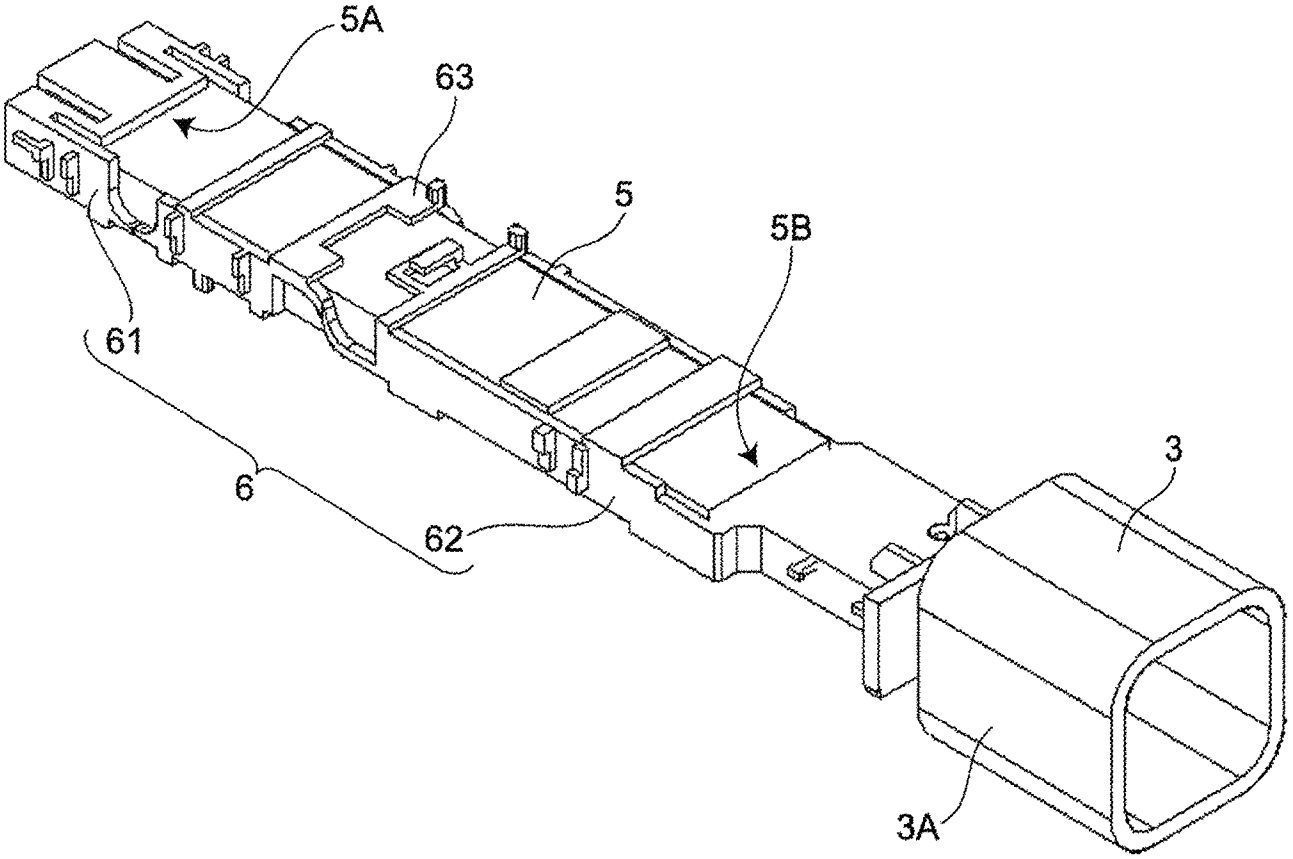
FIG. 6 is a perspective view that illustrates a process subsequent to FIG. 5.

Then, as illustrated in FIG. 6, the core 5 is inserted into the first holding section 61 in the bobbin 6, the sliding member 63, and the second holding section 62 in the bobbin 6. The core 5 may be press-fitted so as to be maintained at a relative position with respect to the first holding section 61 in the bobbin 6, the sliding member 63, and the second holding section 62 in the bobbin 6 by frictional force. The core 5 may be fixed to the first holding section 61 and second holding section 62 in the bobbin 6 by an adhesive or the like.

Figure 7:
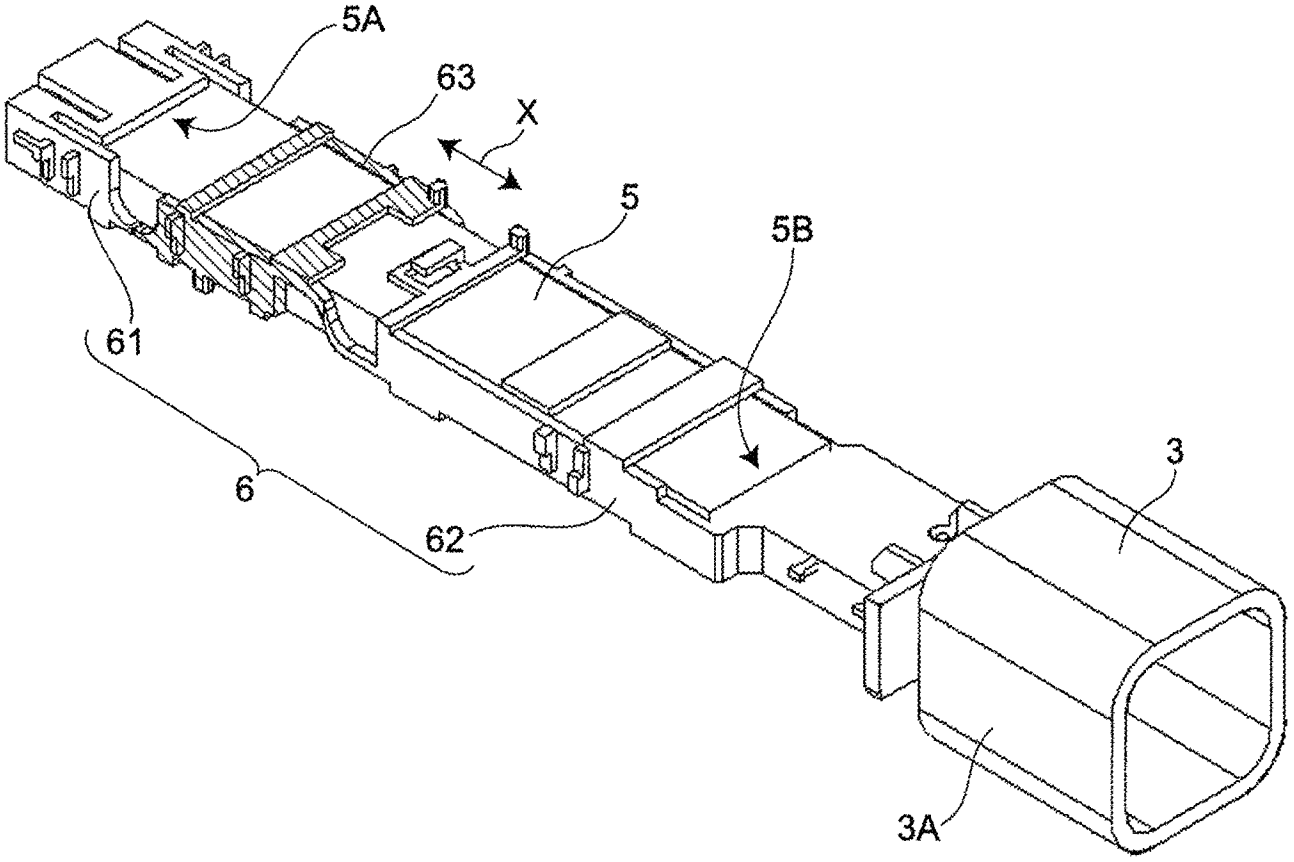
FIG. 7 is a perspective view that illustrates a process subsequent to FIG. 6.

Then, as illustrated in FIG. 7, the sliding member 63 is cut and detached from the first holding section 61 and second holding section 62 in the bobbin 6. In this way, the sliding member 63 becomes movable in the extending direction X of the core 5.

Figure 8:
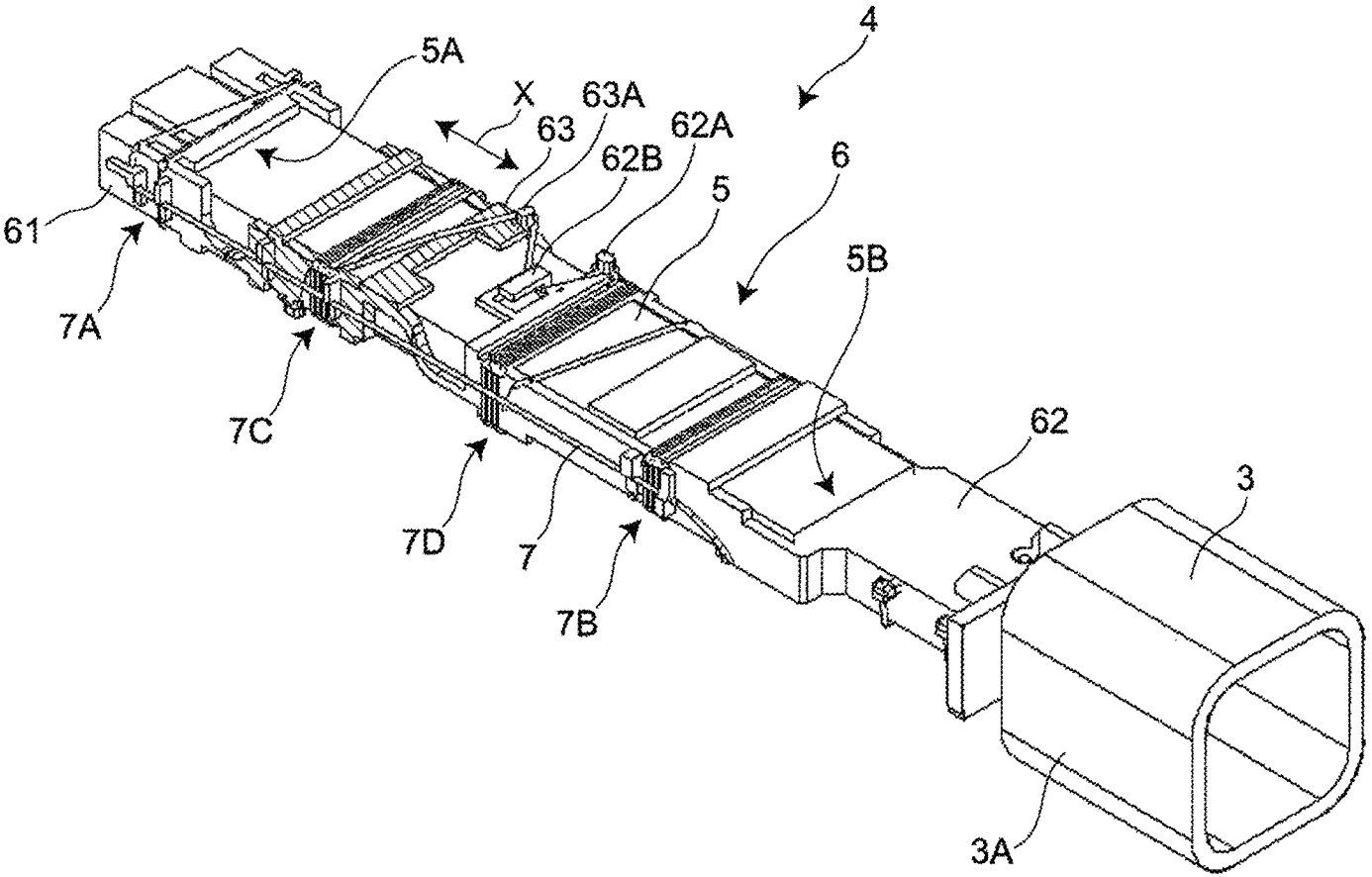
FIG. 8 is a perspective view that illustrates a process subsequent to FIG. 7.

Then, as illustrated in FIG. 8, the wire 7 is wound around the first holding section 61 in the bobbin 6, the sliding member 63, and the second holding section 62 in the bobbin 6 so as to have a predetermined tension. In this way, the first coil section 7A, second coil section 7B, third coil section 7C, and fourth coil section 7D are formed. At this time, the first end portion 7*a* and second end portion 7*b* of the wire 7 are connected to the connector pins in the connector 3 by, for example, soldering, fusing, welding, or the like.

In the present embodiment, the wire 7 is also wound on a pin 62A and a regulating member 62B in the second holding section 62 in the bobbin 6 and a pin 63A in the sliding member 63 so as to have a predetermined tension. The pin 62A and pin 63A are disposed at locations adjacent to each other with a space where the sliding member 63 is movable interposed therebetween. The wire 7 positioned between the pin 62A and pin 63A is routed on the regulating member 62B. The regulating member 62B is configured to regulate movement of a near portion of the third coil section 7C in a direction that becomes remote from the core 5 when the third coil section 7C is moved in the extending direction X of the core 5.

Figure 9:
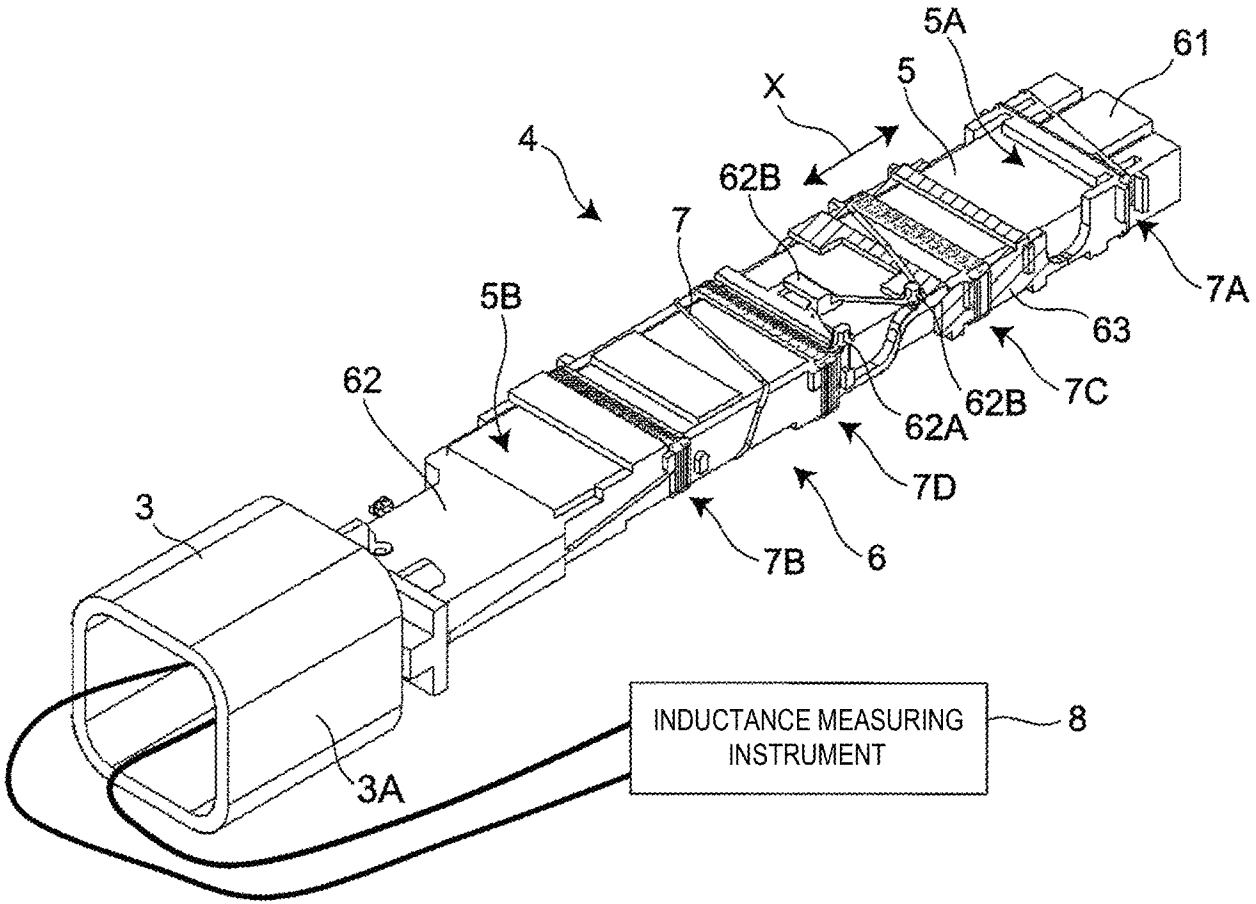
FIG. 9 is a perspective view that illustrates a process subsequent to FIG. 8.

Then, as illustrated in FIG. 9, an inductance measuring instrument 8, such as impedance analyzer, is connected to the connector pins in the connector 3.

Figure 10:
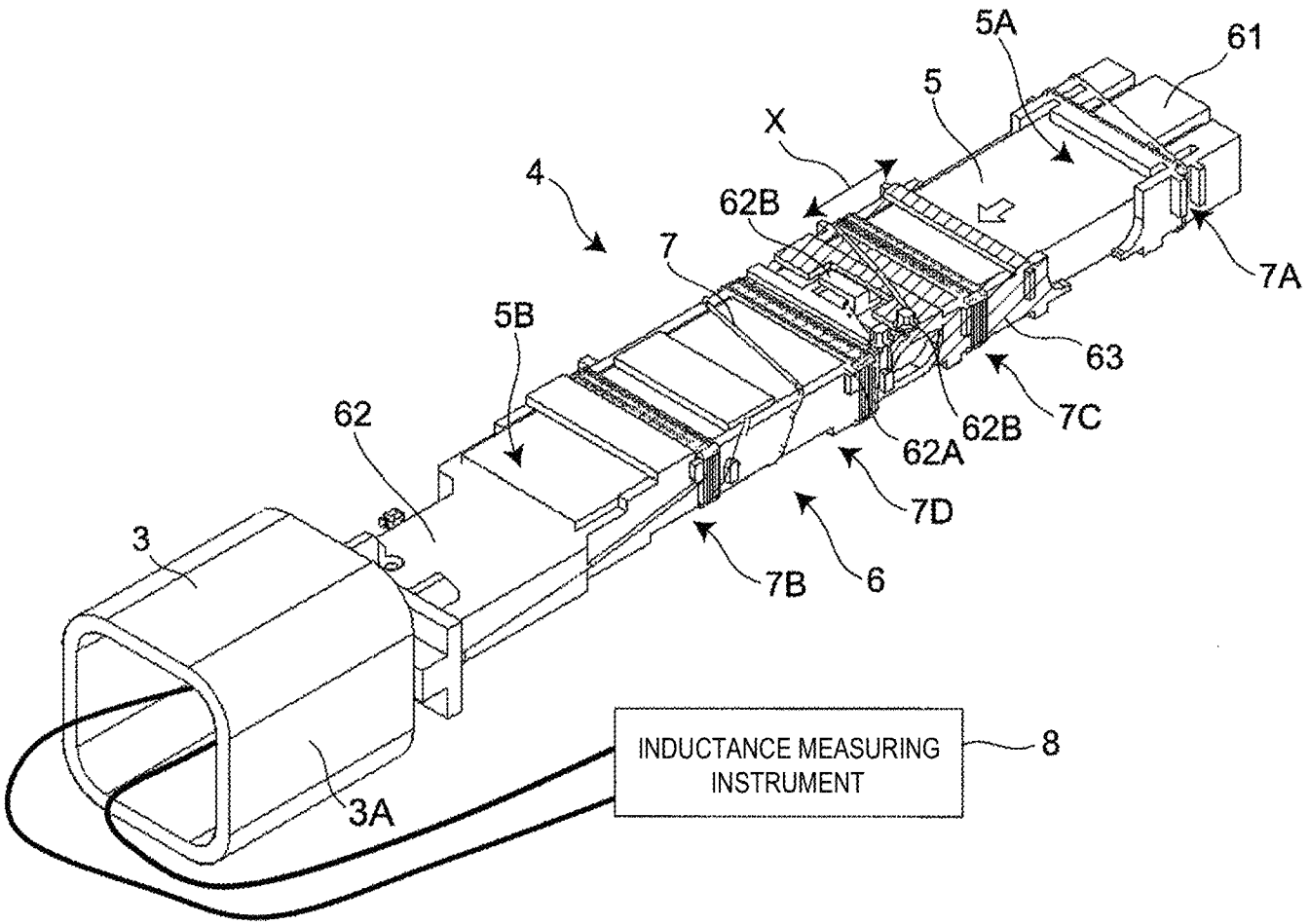
FIG. 10 is a perspective view that illustrates a process subsequent to FIG. 9.
Figure 12:
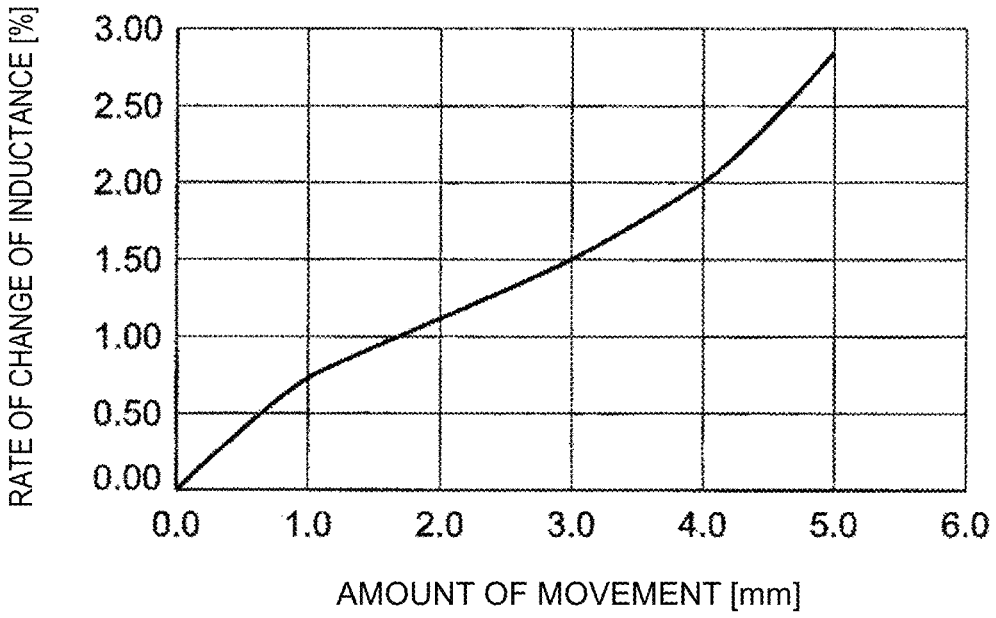
FIG. 12 is a graph that illustrates a relationship between the amount of movement of the sliding member and the rate of change of inductance.

Then, as illustrated in FIG. 10, the sliding member 63 is moved in the extending direction X of the core 5, and the inductance measured by the inductance measuring instrument 8 is changed to a desired value. For example, as illustrated in FIG. 12, when the sliding member 63 is moved by 3.0 mm, the inductance can be changed by about 1.5%. When the sliding member 63 is moved by 4.0 mm, for example, the inductance can be changed by about 2.0%. It is confirmed that the output strength remains virtually unchanged.

When the sliding member 63 is moved, the tension of the wire 7 may be excessively increased, and this may cause a break of the wire 7. To avoid this situation, for example, at the time of winding the wire 7, the wire 7 may be hung on a temporary hook (not illustrated) disposed on the bobbin 6 or sliding member 63, and before the sliding member 63 is moved, the wire 7 may be removed from the temporary hook to slacken the tension of the wire 7. In this case, the regulating member 62B can suppress swaying of the near portion of the third coil section 7C caused by vibration or the like, as in the above-described case, and thus, malfunctions, such as breaks, can be suppressed. In this case, in order to prevent swaying of the wire 7, the wire 7 can be fixed to the bobbin 6 or sliding member 63 by an adhesive or the like according to exemplary aspects.

Figure 11:
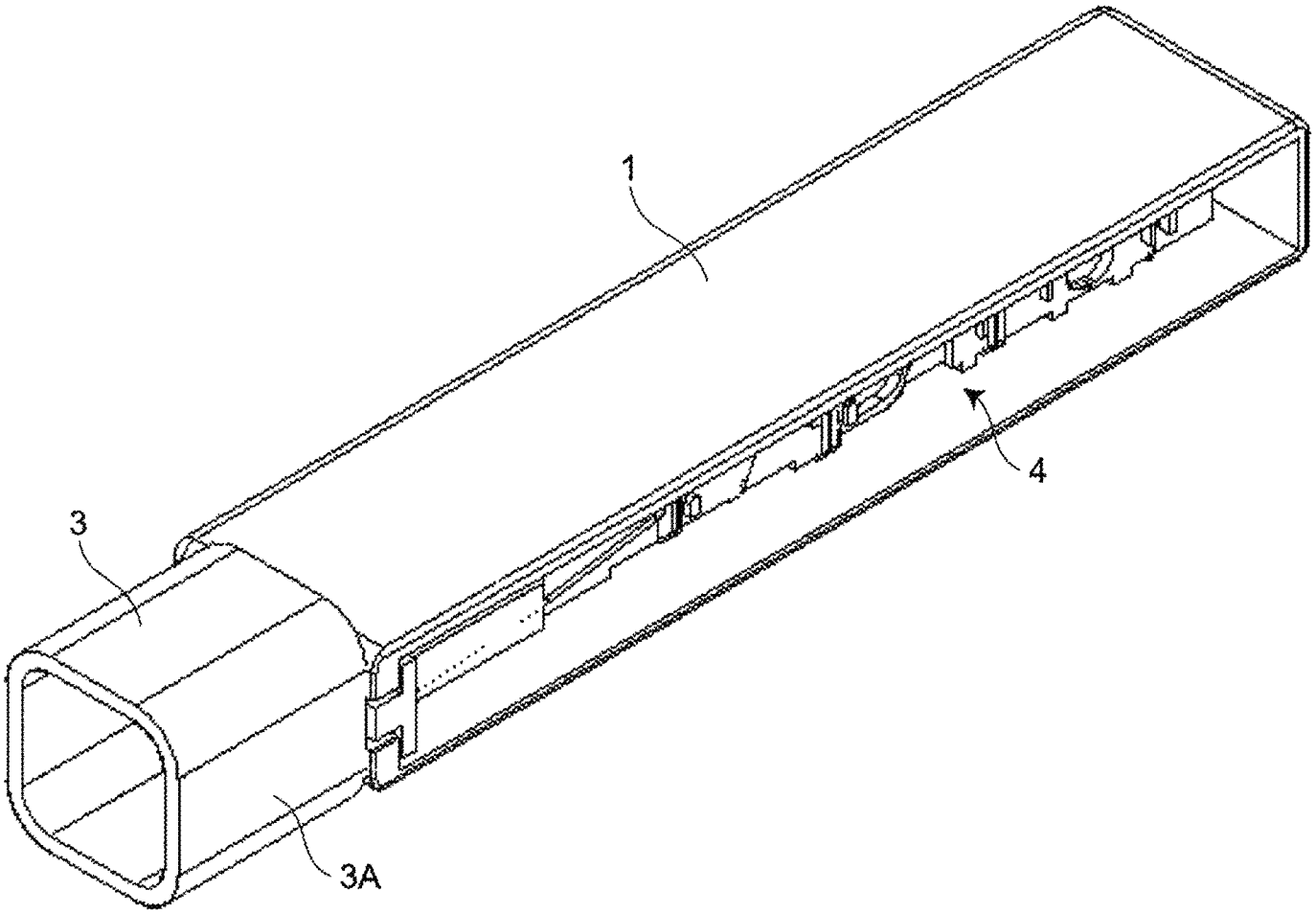
FIG. 11 is a perspective view that illustrates a process subsequent to FIG. 10.

Then, as illustrated in FIG. 11, the antenna coil 4 is held in the antenna case 1.

Next, the cover 2 is inserted into the antenna case 1 so as to cover the antenna coil 4. In this way, the antenna device illustrated in FIG. 1 is produced.

It is noted that the exemplary aspects of the present invention are not limited to the above-described embodiment and can be carried out in various forms. For example, in the foregoing, after the core 5 is inserted into the first holding section 61 in the bobbin 6, the sliding member 63, and the second holding section 62 in the bobbin 6, the wire 7 is wound around the first containing section 61, second holding section 62, and sliding member 63, but the present invention is not limited to thereto.

In another exemplary aspect, before the insertion of the core 5 into the first holding section 61 in the bobbin 6, the sliding member 63, and the second holding section 62 in the bobbin 6, the wire 7 can be wound around the first holding section 61, second holding section 62, and sliding member 63.

In the foregoing, after the sliding member 63 is cut and separated from the first holding section 61 and second holding section 62 in the bobbin 6, the wire 7 is wound around the first holding section 61, second holding section 62, and sliding member 63, but the present invention is not limited thereto. For example, before the sliding member 63 is cut and separated from the first holding section 61 and second holding section 62 in the bobbin 6, the wire 7 can be wound around the first holding section 61, second holding section 62, and sliding member 63. It is noted, however, that the configuration in which the wire 7 is wound after the sliding member 63 is cut can more suppress the occurrence of inadvertent cutting of the wire 7 at the time of cutting the sliding member 63.

In the foregoing, immediately after the antenna coil 4 is held in the antenna case 1, the cover 2 is inserted into the antenna case 1, but the present invention is not limited thereto. For example, after the antenna coil 4 is held in the antenna case 1, potting with a resin, such as urethane, may be performed to improve its waterproofness.

In the foregoing, the wire 7 includes the four coil sections 7A to 7D, but the present invention is not limited thereto. In general, the wire 7 includes at least three coil sections, including the first coil section 7A and second coil section 7B.

In another exemplary aspect of the foregoing, a gap is present between neighboring ones of the coil sections 7A to 7D, but there may be no gaps. That is, the wire 7 may be spirally wound at uniform intervals.

In the foregoing, the third coil section 7C is moved in the extending direction X of the core 5, but the present invention is not limited thereto. For example, the fourth coil section 7D may be moved in the extending direction X of the core 5. That is, the coil section movable in the extending direction X of the core 5 may be any coil section positioned between the first coil section 7A and second coil section 7B.

Figure 13:
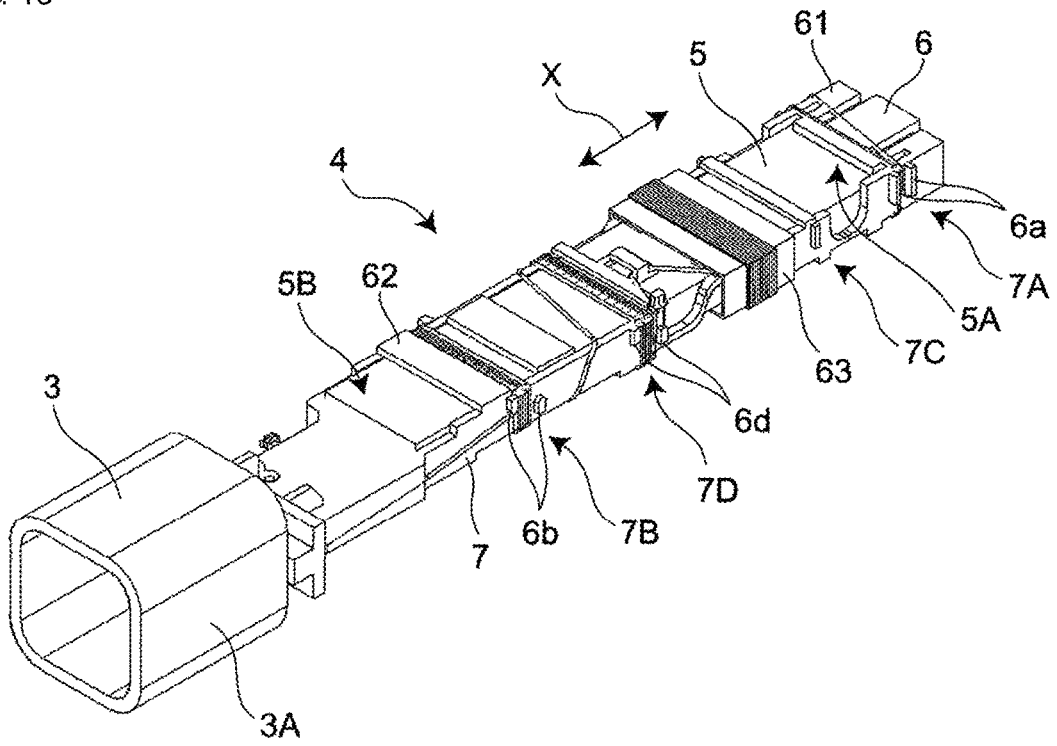
FIG. 13 is a perspective view that illustrates a first variation of the antenna coil.

In the foregoing, the bobbin 6 is formed of the first holding section 61 and second holding section 62, but it is noted that the present invention is not limited thereto. For example, the bobbin 6 may be formed of three or more members. As illustrated in FIG. 13, the bobbin 6 may be formed of one member extending in the extending direction X of the core 5, and the sliding member 63 may be arranged around the bobbin 6 such that it is movable in the extending direction X of the core 5. In this case, examples of the material of the sliding member 63 may include a metal and paper, in addition to a resin.

Figure 14:
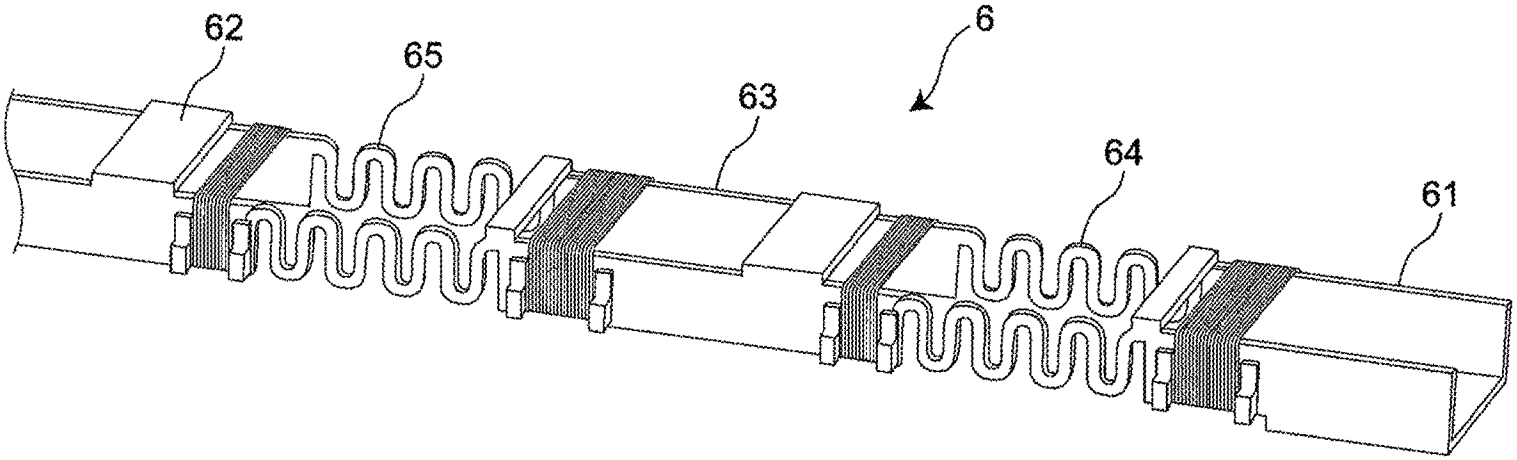
FIG. 14 is a perspective view that illustrates a second variation of the antenna coil.

In the foregoing, the bobbin 6 and sliding member 63 are different components, but the present invention is not limited thereto. For example, in another exemplary aspect the bobbin 6 itself may include the sliding member 63. In this case, for example, the bobbin may have springiness in a portion of a region between a first end portion and a second end portion thereof (that is, portion other than the first and second end portions). More specifically, as illustrated in FIG. 14, the first holding section 61 and sliding member 63 may be integrated with each other with an elastic section 64 having springiness interposed therebetween, and second holding section 62 and sliding member 63 may be integrated with each other with an elastic section 65 having springiness interposed therebetween. In this configuration, when one of the elastic sections 64 and 65 expands and the other of the elastic sections 64 and 65 shrinks, the sliding member 63 can be moved in the extending direction X of the core 5. Accordingly, the third coil section 7C can be moved without having the sliding member 63 as a component different from the bobbin 6, and the inductance can be adjusted while variations in the output strength can be suppressed.

In addition, the third coil section 7C or fourth coil section 7D can preferably be movable within a range nearer the first end portion 5A or second end portion 5B of the core 5 than the central portion of the core 5. Because the wire positioned within the range near the first end portion 5A or second end portion 5B of the core 5 significantly affects a magnetic flux output from the core 5, the inductance can be adjusted by a smaller amount of movement.

Yet further, the third coil section 7C or fourth coil section 7D can be movable within a range nearer the central portion of the core 5 than the first end portion 5A or second end portion 5B of the core 5 according to exemplary aspects. Because the wire positioned within the range near the central portion of the core 5 less affects the magnetic flux output from the core 5, the inductance can be adjusted while variations in the output strength can be further suppressed.

In general, because the antenna coil according to the present invention can adjust the inductance while suppressing variations in the output strength, it can be effective as an antenna coil for use in long-distance communications, such as a smart keyless system.

REFERENCE SIGNS LIST

1 antenna case
1*a*, 1*b* side surface
1*c* cut section
2 cover
2*b* side surface
2*c* cut section
3 connector
3A sleeve
4 antenna coil
5 core
5A first end portion
5B second end portion
6 bobbin
6*a*, 6*b*, 6*d* rib
7 wire
7*a* first end portion
7*b* second end portion
7A first coil section
7B second coil section
7C third coil section
7D fourth coil section
8 inductance measuring instrument
61 first holding section
62 second holding section
62A pin
62B regulating member
63 sliding member
63A pin
64, 65 elastic section

The invention claimed is:

1. An antenna coil comprising:

a bar-shaped core comprising a magnetic material;

a bobbin configured to hold the bar-shaped core; and a wire wound around the bobbin and including a first coil section disposed at a position corresponding to a first end of the bar-shaped core, a second coil section disposed at a position corresponding to a second end of the bar-shaped core, and a third coil section positioned between the first coil section and the second coil section and configured to be moved in an extending direction of the bar-shaped core to adjust an inductance of the antenna coil.

2. The antenna coil according to claim 1, further comprising a sliding member disposed around a region between the first and second ends of the bar-shaped core and configured to be moved in the extending direction of the bar-shaped core.

3. The antenna coil according to claim 2, wherein the third coil section is wound around the sliding member and configured to be moved in the extending direction of the bar-shaped core based on movement of the sliding member.

4. The antenna coil according to claim 3, wherein the bobbin extends in the extending direction of the bar-shaped core, and the sliding member is disposed around the bobbin.

5. The antenna coil according to claim 3, wherein the bobbin includes a first holding section configured to hold the first end of the bar-shaped core and a second holding section configured to hold the second end of the bar-shaped core.

6. The antenna coil according to claim 5, wherein the sliding member is disposed between the first and second holding sections and comprises a same material as the bobbin.

7. The antenna coil according to claim 1, wherein the bobbin extends in the extending direction of the bar-shaped core, and the bobbin has springiness in a portion of a region between a first and second ends thereof.

8. The antenna coil according to claim 1, wherein the third coil section is configured to be moved within a range closer to the first end or the second end of the bar-shaped core than a center of the bar-shaped core.

9. The antenna coil according to claim 1, wherein the third coil section is configured to be moved within a range closer to a center of the bar-shaped core than either of the first or second ends of the bar-shaped core.

10. The antenna coil according to claim 1, further comprising a regulating member configured to regulate movement of the third coil section in a direction remote from the bar-shaped core when the third coil section is moved in the extending direction of the bar-shaped core.

11. An antenna coil comprising:

a magnetic core having first and second opposing ends;

a bobbin configured to hold the magnetic core;

a sliding member disposed between the first and second ends of the magnetic core and configured to be moved in a lengthwise direction of the magnetic core; and a wire wound around the bobbin and including a first coil section disposed towards the first end of the magnetic core, a second coil section disposed towards the second end of the magnetic core, and a third coil section coupled to the sliding member and between the first and second coil sections, wherein the sliding member is configured to move the third coil section in the lengthwise direction of the magnetic core to adjust an inductance of the antenna coil.

12. The antenna coil according to claim 11, wherein the sliding member is integrally formed as a component of the bobbin.

13. The antenna coil according to claim 11, wherein the third coil section is wound around the sliding member and configured to be moved in the lengthwise direction of the magnetic core based on movement of the sliding member.

14. The antenna coil according to claim 13, wherein the bobbin extends in the lengthwise direction of the magnetic core, and the sliding member is disposed around the bobbin.

15. The antenna coil according to claim 13, wherein the bobbin includes a first holding section configured to hold the first end of the magnetic core and a second holding section configured to hold the second end of the magnetic core.

16. The antenna coil according to claim 15, wherein the sliding member is disposed between the first and second holding sections and comprises a same material as the bobbin.

17. The antenna coil according to claim 11, wherein the bobbin extends in the lengthwise direction of the magnetic core, and the bobbin has springiness in a portion of a region between a first and second ends thereof.

18. The antenna coil according to claim 11, wherein the third coil section is configured to be moved within a range closer to the first end or the second end of the magnetic core than a center of the magnetic core.

19. The antenna coil according to claim 11, wherein the third coil section is configured to be moved within a range closer to a center of the magnetic core than either of the first or second ends of the magnetic core.

20. The antenna coil according to claim 11, further comprising a regulating member configured to regulate movement of the third coil section in a direction remote from the magnetic core when the third coil section is moved in the lengthwise direction of the magnetic core.

* * * * *